United States Patent [19]

Merlette

[11] 4,177,440

[45] Dec. 4, 1979

[54] MOVING-ARMATURE ELECTROMAGNETIC DEVICE

[75] Inventor: Didier Merlette, Mouy, France

[73] Assignee: Techniques Europeennes de Commutation (T.E.C.), Mouy, France

[21] Appl. No.: 929,359

[22] Filed: Jul. 31, 1978

[30] Foreign Application Priority Data

Aug. 5, 1977 [FR] France ..... 77 24241

[51] Int. Cl.[2] ..... H01F 7/12

[52] U.S. Cl. ..... 335/247; 335/258

[58] Field of Search ..... 335/248, 249, 257, 258, 335/277, 247

[56] References Cited

U.S. PATENT DOCUMENTS 985,676 2/1911 Howe ..... 335/248 X 3,400,351 9/1968 Flentge ..... 335/277 X

FOREIGN PATENT DOCUMENTS 2707078 9/1977 Fed. Rep. of Germany ..... 335/257

*Primary Examiner*—George Harris

[57] ABSTRACT

The invention relates to a moving-armature electromagnetic device such as a plunger core electromagnet wherein a ring of a non-magnetic material with an appropriate anti-friction coefficient is placed between the armature and the seat which cooperates with said armature. Said ring permits to reduce to a minimum both the frictional forces and the remanence forces between said armature and said seat.

6 Claims, 2 Drawing Figures

MOVING-ARMATURE ELECTROMAGNETIC DEVICE

Figure 1:
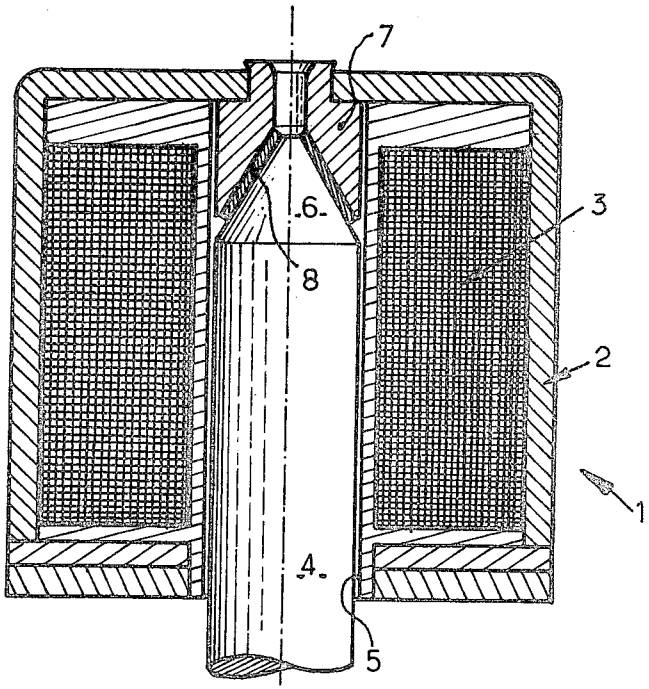

The present invention relates generally to a moving-armature electromagnetic device and has more particularly for its object to provide a plunger core electromagnet and a method of manufacture thereof.

In certain types of single-action plunger-core electromagnets, the core terminates at one end with a tapering surface or male cone which, when the electromagnet is energized, engages a seat of complementary shape or female cone secured to the electromagnet yoke.

This arrangement allows a better force-against-travel curve to be obtained than with a core end in the form of a plane surface perpendicular to the axis of the said core. The return of the core to its rest position when the electromagnet is not energized is usually ensured by a spring or by gravity, and the return force is often very small.

However, the moment the electromagnet is de-energized by switching off the current flowing through the exciting coil while the main cone of the core is still engaged in the female cone of the seat, there occur two effects which tend to oppose the return of the core to its rest position, namely:

a magnetic effect, i.e. a remanence force, a mechanical effect, i.e. a frictional force.

In order to obviate, in particular, the effect of the frictional forces, an attempt has already been made to slightly vary the angles of the male and female cones. More precisely, a slightly more acute angle has been selected for the male cone of the plunger core than for the female cone of the seat so that friction occurred on as small a diameter as possible.

In the case of push-type electromagnets, a stem is mounted in axial prolongation of the plunger core and passes through the seat. This stem is sometimes screwed in the plunger, but then the cost is relatively high owing to the necessity of preventing casual unscrewing under the action of vibrations. Another solution consists in press-fitting or tightly introducing the stem into the plunger, but this results in a slight expansion of the inlet of the core cone causing it to be retained or blocked in the seat in case the return force is small.

It is an object of the invention to obviate the above drawbacks by allowing the problems resulting from the remanence force and the frictional force exerted between the core and its seat to be avoided at the time of de-energizing of the electromagnet.

To this end, the invention provides a method of manufacture of an electromagnetic device with a moving armature intended to engage a seat portion of the said device so as to close the magnetic flux lines when the said device is energized, characterized in that it consists, in order to reduce to a minimum both the frictional forces and the sticking of the said armature to the said seat as a result of magnetic remanence, in providing between the said armature and the said seat a substantially continuous and uniform gap of nonmagnetic material with an appropriate anti-friction coefficient.

The invention also provides a moving-armature electromagnetic device such as a plunger core electromagnet, the said core being adapted to engage a seat supported by the yoke of the said electromagnet when the latter is energized, characterized in that it comprises a non-magnetic anti-friction ring arranged between the said plunger core and the said seat.

One advantage of the invention is the reduction in remanence and frictional forces allowing the plunger to return to its rest position under the action of a small force usually exerted by a spring.

Another advantage of the invention is that the non-magnetic ring between the plunger core and the seat provides therebetween a gap allowing thermally untreated mild or soft steels to be used for manufacturing the core and the seat, instead of thermally treated pure irons.

Figure 2:
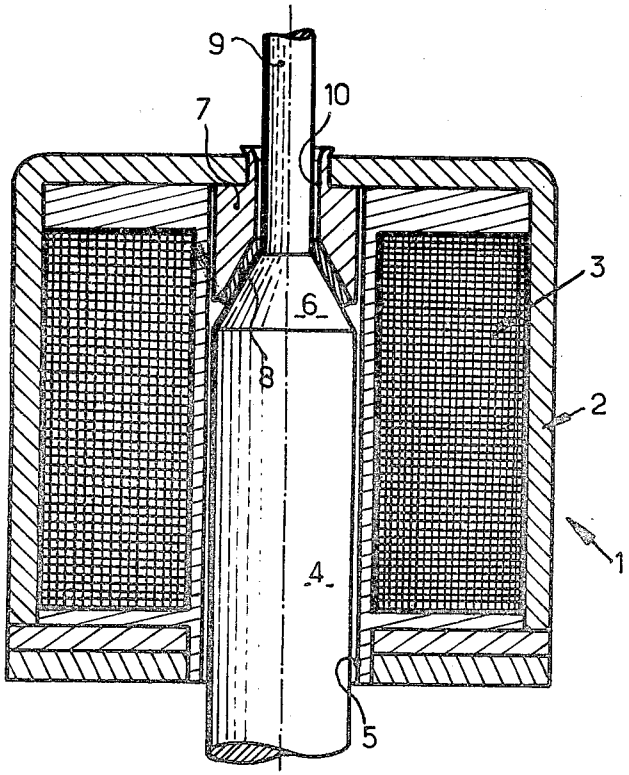

Other advantages, characterizing features and details of the invention will appear more clearly as the following explanatory description proceeds with reference to the appended drawings given solely by way of example and wherein:

FIG. 1 is a longitudinal, partially sectional view of a plunger-core electromagnet according to the invention, and FIG. 2 is a longitudinal, partially sectional view of a push-type plunger-core electromagnet according to the invention.

Referring to FIG. 1, the single-acting electromagnet 1, comprises a yoke 2 of magnetic material within which is mounted an exciting coil 3. The plunger core 4 of magnetic material, which is freely mounted in the internal space defined by the coil and in axial relationship to the latter, passes towards one of its ends through an opening 5 of the yoke 2 of the electromagnet. This end of the plunger is adapted to co-operate with a movable element which the electromagnet 1 is intended to actuate. The other end of the plunger core 4 ends with a tapering surface 6 or male cone adapted to co-operate with a seat 7 which also is of magnetic material and the shape of which is complementary to the female cone secured to the yoke 2 of the electromagnet 1.

Between the male cone 6 of the plunger core 4 and the seat 7 is arranged a tapering ring 8 of anti-friction and therefore non-magnetic plastics material. The ring 8 is for example cut in one piece from a block of material such as filled or reinforced teflon ensuring high impact strength or rigidity. Of course, any other kind of sintered, moulded, machined metal or plastics non-magnetic material obtained by any other method may be used. In the example illustrated, the ring 8 is secured to the seat 7, but it may as well as fastened to the male cone 6 of the plunger core 4 or left floating therebetween.

Consequently, when the coil 3 is energized by a current passing therethrough, the plunger core 4, which is then in its position of rest or away from the seat 7 of the electromagnet, is urged towards and into contact with the seat through the medium of its male cone 8 which thus engages the ring 6 secured to the seat.

The push-type plunger-core electromagnet represented in FIG. 2 differs from the one shown in FIG. 1 solely by the fact that the male cone 6 of the plunger core 4 is prolonged by an actuating stem or rod 9 passing through the electromagnet seat 7 and yoke 2 through an orifice 10. The operating principle of this type of electromagnet is the same as above.

Therefore, at the time the electromagnet is de-energized by cutting off the current flowing through the coil, the ring 8 considerably and simultaneously reduces the remanence force owing to the presence of a continuous and uniform gap constituted by the said ring and the frictional forces between the plunger cone and its seat secured to the electromagnet yoke.

Such a structure, therefore, allows the problems connected with the remanence and frictional forces occur-ring at the time of de-energizing of the electromagnet to be simultaneously reduced, thus reducing to a low value the return force necessary to move the plunger core back to its rest position. This return force is usually obtained by means of a spring (not shown).

Moreover, the fact that the core and the seat can be made of mild or soft, thermally untreated steel allows substantial saving to be achieved in both the cost of the material and the machining expenses.

The invention may also be applied to electromagnetic devices other than plunger core electromagnets, such as for example electromagnetic relays.

Of course the invention is by no means limited to the forms of embodiment described and illustrated, which have been given by way of example only. In particular, it comprises all means constituting technical equivalents to the means described as well as their combinations should the latter be carried out according to its gist and used within the scope of the following claims.

What is claimed is:

1. A moving-armature electromagnetic device comprising: a moveable core; a seat portion engageable by an end of said core to close the magnetic flux lines when the device is energized, said seat portion and said end of said core having complementary tapered surfaces; and a non-magnetic anti-friction ring positioned between said core and said seat to reduce the frictional forces and the magnetic remanence forces between said core and said seat.

2. The device as claimed in claim 1, wherein said ring is formed of a non-magnetic metal.

3. The device as claimed in claim 1, wherein said ring is formed of plastic.

4. The device as claimed in claim 1, wherein said ring is formed of teflon.

5. The device as claimed in claim 1, wherein said core and said seat are formed of soft unhardened steel.

6. A moving-armature electromagnetic device comprising: a moveable core; a seat portion engageable by an end of said core to close the magnetic flux lines when the device is energized, said seat portion and said end of said core having complementary tapered surfaces; an actuator stem extending from said end of said core and passing through an opening in said seat; and a non-magnetic anti-friction ring positioned between said core and said seat to reduce the frictional forces and the magnetic remanence forces between said core and said seat.

* * * * *